United States Patent [19]

Kindlimann

[11] 4,006,012

[45] Feb. 1, 1977

[54] AUSTENITIC ALLOY

[75] Inventor: Lynn E. Kindlimann, Milford, Conn.

[73] Assignee: Allegheny Ludlum Industries, Inc., Pittsburgh, Pa.

[22] Filed: Mar. 27, 1975

[21] Appl. No.: 562,619

Related U.S. Application Data

[60] Continuation of Ser. No. 406,723, Oct. 15, 1973, abandoned, which is a division of Ser. No. 100,078, Dec. 21, 1970, Pat. No. 3,843,332.

[52] U.S. Cl. ..... 75/122; 75/123 K; 75/124; 75/128 T; 75/171

[51] Int. Cl.[2] ..... C22C 19/03; C22C 38/08; C22C 38/10

[58] Field of Search ..... 75/122, 123 K, 124, 75/171, 128 T

[56] References Cited

UNITED STATES PATENTS

| | | | |
|---|---|---|---|
| 2,266,482 | 12/1941 | Pilling et al. | 75/128 T |
| 3,048,485 | 8/1962 | Bieber | 75/171 |
| 3,065,068 | 11/1962 | Dyrkacz et al. | 75/124 |
| 3,183,084 | 5/1965 | Heydt | 75/128 T |
| 3,184,577 | 5/1965 | Witherell | 75/128 T |

*Primary Examiner*—W. Stallard
*Attorney, Agent, or Firm*—Vincent G. Gioia; Robert F. Dropkin

[57] ABSTRACT

An austenitic alloy containing, in weight percent, from 36 to 54% nickel, up to 12% cobalt, up to 15% chromium, up to 10% molybdenum, from 1 to 3.75% titanium, up to 2% aluminum, up to 0.1% carbon, up to 2% manganese, up to 1% silicon, up to 0.05% boron, balance essentially iron; wherein the percentage of iron is at least 24%; wherein the percentage of nickel plus the percentage of cobalt and the percentage of chromium plus the percentage of molybdenum corresponds to the area ACEFA in FIG. 3; and wherein the percentage of nickel is the effective nickel in accordance with the equation:

$$\% \text{ effective Ni} = \% \text{ actual Ni} - 2.4\,[(\%\text{Ti} - 2.8) - 4(\%\text{C})]$$

A composite article comprised of a ferritic steel member fastened to a second member with a fastener formed from the austenitic alloy of this invention.

11 Claims, 3 Drawing Figures

AUSTENITIC ALLOY

This is a continuation of application Ser. No. 406,723 filed Oct. 15, 1973, and now abandoned which in turn is a division of application Ser. No. 100,078 filed Dec. 21, 1970, now U.S. Pat. No. 3,843,332 issued Oct. 22, 1974.

The present invention relates to a high-iron austenitic alloy having both ferritic-like thermal expansion and high temperature strength and to a composite article comprised of a ferritic steel member fastened to a second member with a fastener formed from the high-iron austenitic alloy of this invention.

The lack of a suitable alloy for fastening ferritic materials subjected to high temperatures and pressures; e.g., AISI 4340 steel steam turbine casings, has plagued materials engineers for quite some time. Fasteners formed from ferritic and martensitic alloys; e.g., AISI Type 422 stainless steel, lack sufficient high temperature strength, even though the martensitic alloys are considerably stronger than the ferritic alloys, and fasteners formed from austenitic alloys with sufficient high temperature strength, have too high a rate of thermal expansion, which permits considerable loosening on heating to service temperatures.

The present invention simplifies the work of materials engineers. It provides a high-iron austenitic alloy having both ferritic-like thermal expansion and high temperature strength on the order of that possessed by the high temperature austenitic alloys which constitute the prior art. In addition, it provides a composite article comprised of a ferritic steel member fastened to a second member with a fastener formed from the high temperature austenitic alloy of this invention.

Illustrative high temperature austenitic alloys are disclosed in U.S. Pat. Nos. 3,048,485 and 3,183,084 which respectively issued on Aug. 7, 1962 and May 11, 1965. The alloys disclosed in the patents do not have the combination of high temperature strength and ferritic-like thermal expansion possessed by the alloys of the present invention.

It is accordingly an object of this invention to provide a high-iron austenitic alloy having both ferritic-like thermal expansion and high temperature strength on the order of that possessed by the high temperature austenitic alloys which constitute the prior art.

It is a further object of this invention to provide a composite article comprised of a ferritic steel member fastened to a second member with a fastener formed from the high-iron austenitic alloy of this invention.

The foregoing and other objects of the invention will be best understood from the following description, reference being had to the accompanying drawings wherein.

Figure 3:
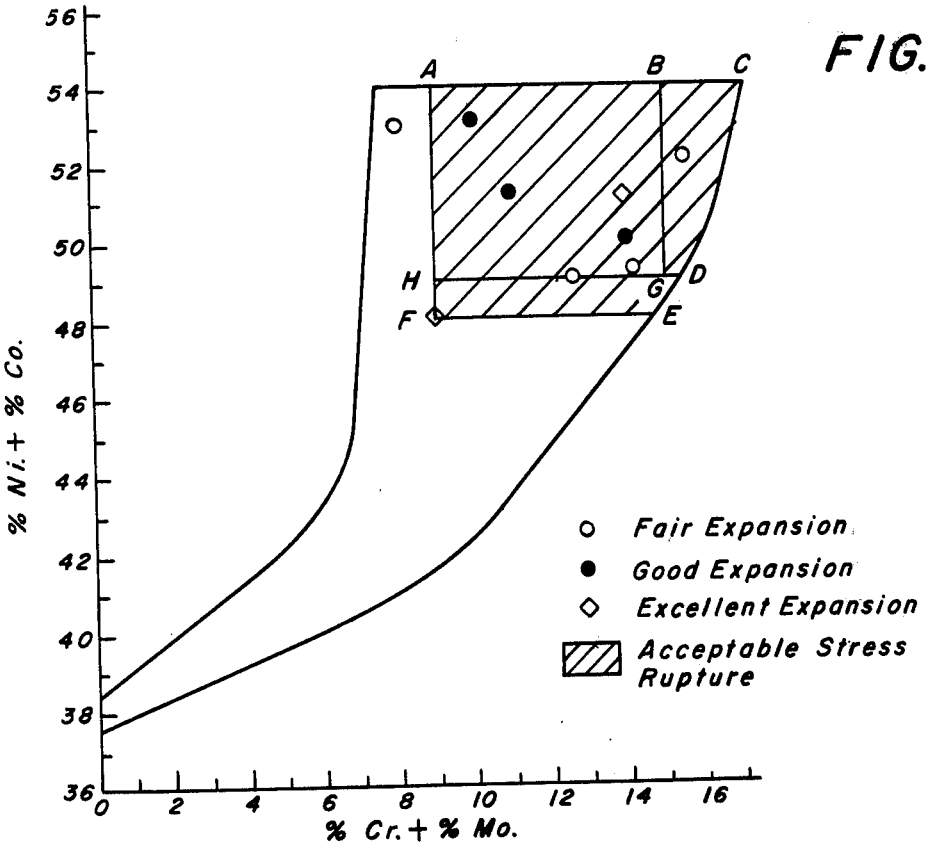
FIG. 3 is a plot (% Ni plus % Co versus % Cr + % Mo) defining an area of acceptable thermal expansion and acceptable stress rupture.

The austenitic alloy of the present invention has a composition consisting essentially of, in weight percent, from 36 to 54% nickel, up to 12% cobalt, up to 15% chromium, up to 10% molybdenum, from 1 to 3.75% titanium, up to 2% aluminum, up to 0.1% carbon, up to 2% manganese, up to 1% silicon, up to 0.05% boron, balance essentially iron; wherein the percentage of iron is at least 24%; wherein the percentage of nickel plus the percentage of cobalt and the percentage of chromium plus the percentage of molybdenum corresponds to the area ACEFA in FIG. 3; and wherein the percentage of nickel is the effective nickel in accordance with the equation:

$$\% \text{ effective Ni} = \% \text{ actual Ni} - 2.4\ [(\%\text{Ti} - 2.8) - 4(\%\text{C})]$$

An object of the present invention is to provide an alloy having ferritic-like thermal expansion. Ferritic steels such as AISI 4340 are ferromagnetic at room temperature and have relatively high inflection points (Curie points); i.e., the temperature at which a ferromagnetic material becomes paramagnetic. Inflection points are major factors in considering the thermal expansion characteristics for alloys as ferromagnetic alloys have fairly low expansion rates and paramagnetic alloys have fairly high expansion rates.

Nickel is necessary in the alloy of the present invention to raise the alloy's inflection point and to provide the alloy with a combination of ferritic-like thermal expansion, and high temperature strength. The amount of nickel is from 36 to 54% and preferably from 43 to 49%. A maximum of 54% nickel is imposed on the alloy as nickel alters the alloy's rate of thermal expansion and alloys with nickel contents in excess of 54% have a rate of thermal expansion which is not compatible with alloy steels such as AISI 4340.

The nickel content for the alloy of this invention is the effective nickel content as contrasted to the actual nickel content, in accordance with the following equation, taken from Pilling and Talbot, *Age Hardening of Metals*, ASM (1940), pages 249 – 257, and normalized for 2.8% titanium:

$$\% \text{ effective Ni} = \% \text{ actual Ni} - 2.4\ [(\%\text{Ti} - 2.8) - 4(\%\ \text{C})]$$

Nickel and titanium enter into precipitation hardening reactions involving the formation of an $Ni_3Ti$ intermetallic compound which necessitates the consideration of nickel removel from the matrix. As explained by Pilling and Talbot, nickel removal leads to the concept of an effective matrix nickel level which is lower than the overall composition of the material and it is this effective nickel level that becomes the factor controlling the inflection point. Although the equation is based upon the formation of an $Ni_2Ti$ precipitate which is now known to be $Ni_3Ti$, it is still usable as it assumes that all of the titanium reacts with nickel, which in fact is not true, as some titanium is dissolved by the matrix without forming a precipitate.

Cobalt is present in amounts up to 12% and preferably in amounts up to 6%. Additions of cobalt are made to adjust the alloy's rate of thermal expansion to be compatible with alloy steels such as AISI 4340 and to provide the alloy with high temperature strength. A particularly desirable cobalt range is from 2 to 6%.

Chromium is present in amounts up to 15% and preferably in amounts up to 11%. Additions of chromium are made to provide the alloy with the required degree of oxidation and corrosion resistance. A maximum chromium level of 15% is imposed as higher chromium levels deleteriously affect the beneficial thermal expansion characteristics of the alloy. A particularly desirable chromium range is from 3 to 11%.

Molybdenum is present in amounts up to 10% and preferably in amounts up to 7%. Additions of molybdenum are made to improve the alloy's high temperature strength. Maximum molybdenum levels are imposed as higher molybdenum levels often necessitate lower chromium levels (the percentage of chromium plus the percentage of molybdenum must correspond to the area ACEFA in FIG. 3) which are accompanied by a loss of oxidation and corrosion resistance. A particularly desirable molybdenum range is from 2 to 7%.

The amounts of titanium and aluminum are respectively from 1 to 3.75% and up to 2% and preferably from 2.4 to 3.4% and up to 0.35%. Titanium and aluminum enter into precipitation hardening reactions which improve high temperature strength. Titanium contents in excess of 3.75% are undesirable as they necessitate excessive amounts of nickel.

Carbon, manganese and silicon are respectively kept below 0.1%, 2% and 1% and preferably below 0.04%, 0.25% and 0.25%. Excessive carbon ties up titanium, thus decreasing the amount of titanium available for precipitation hardening and forms undesirable titanium inclusions which detrimentally affect surface quality and both hot and cold workability. Manganese and silicon are generally undesirable in high temperature alloys as they adversely affect stress rupture properties.

Boron is present in amounts up to 0.05% and preferably in amounts up to 0.02%. Boron is added to the alloy to improve its high temperature strength and ductility. A maximum boron level must, however, be imposed as too much boron causes poor hot workability. A particularly desirable boron range is from 0.01 to 0.02%.

The balance of the alloy is essentially iron. Iron is present in amounts of at least 24% and preferably in amounts of at least 28%. The high iron content of the alloy helps keep the cost down. In summary, the present invention, therefore, provides a relatively economical alloy having ferritic-like thermal expansion and high temperature strength on the order of that possessed by the high temperature austenitic alloys which constitute the prior art. The alloy is ferromagnetic at room temperature and has a relatively high inflection point and a Larson-Miller (C=20) extrapolated rupture stress of at least 64 ksi, preferably at least 69 ksi, for 100,000 hours at 1000° F.

To insure the attainment of the properties of this invention it is essential that the percentage of nickel plus the percentage of cobalt and the percentage of chromium plus the percentage of molybdenum correspond to the area ACEFA in FIG. 3. The criticality of this area will become evident from the examples which follow. Within compositional area ACEFA there is, however, a preferred area. The preferred area is bounded by points ABG and H and corresponds to a percentage of nickel plus a percentage of cobalt of from 49 to 54% and a percentage of chromium plus a percentage of molybdenum of from 9 to 15%. Alloys having a composition within the preferred area ABGHA generally have a more desirable combination of thermal expansion characteristics and high temperature strength than do alloys having a composition within areas BCDGB and DEFHD and require smaller quantities of chromium and/or molybdenum than alloys having a composition within area BCDGB.

The composite article of this invention is comprised of a ferritic steel member fastened to a second member with a fastener formed from the austenitic alloy of this invention. No criticality is placed upon the shape of either the ferritic steel member nor the second member. For example, the ferritic steel member could be a steam turbine casing fastened with a bolt formed from the austenitic alloy of this invention or merely a piece of AISI 4340 tubing. The second member could be formed from numerous materials. Illustrative materials include ferritic steel, the austenitic alloy of this invention and AISI Type 422 stainless steel.

The following examples are illustrative of several aspects of the invention.

A number of alloys which demonstrate the criticality of the compositional range of this invention were produced from vacuum induction melts and subsequently reduced into ⅝ inch to ¾ inch round bars. The compositions of the alloys are set forth below in Table I.

TABLE I

| Alloy | Composition (Wt. %)* (Wt. %)* | | | | | | |
|---|---|---|---|---|---|---|---|
| | Cr | Ni | Ti | Al | Mo | Co | Fe |
| 1 | 13.0 | 42.7 | 2.8 | 0.18 | 5.9 | — | Bal. |
| 2 | — | 42.8 | 2.9 | 0.18 | — | — | Bal. |
| 3 | — | 37.8 | 2.8 | 0.23 | — | — | Bal. |
| 4 | 5.0 | 37.8 | 2.8 | 0.23 | — | — | Bal. |
| 5 | — | 39.0 | 2.8 | 0.21 | 2.0 | — | Bal. |
| 6 | — | 40.0 | 2.8 | 0.23 | 4.1 | — | Bal. |
| 7 | 2.9 | 40.0 | 2.8 | 0.23 | 2.0 | — | Bal. |
| 8 | 4.9 | 41.0 | 2.8 | 0.21 | 4.9 | — | Bal. |
| 9 | 5.0 | 42.7 | 2.8 | 0.21 | — | — | Bal. |
| 10 | 5.0 | 43.0 | 2.4 | 0.21 | — | — | Bal. |
| 11 | 3.0 | 40.1 | 2.4 | 0.21 | 2.0 | — | Bal. |
| 12 | 3.0 | 40.0 | 2.9 | 0.19 | 5.0 | — | Bal. |
| 13 | 3.0 | 44.0 | 2.8 | 0.19 | 6.0 | — | Bal. |
| 14 | 8.0 | 50.7 | 2.8 | 0.18 | 6.0 | — | Bal. |
| 15 | 3.0 | 48.0 | 2.9 | 0.20 | 6.0 | — | Bal. |
| 16 | 8.0 | 45.0 | 2.9 | 0.19 | 5.9 | 5.1 | Bal. |
| 17 | 3.9 | 49.8 | 2.7 | 0.21 | 6.1 | 5.0 | Bal. |
| 18 | 7.5 | 46.0 | 2.9 | 0.16 | — | — | Bal. |
| 19 | 7.5 | 46.0 | 3.3 | 0.20 | — | — | Bal. |
| 20 | 5.0 | 44.2 | 3.3 | 0.24 | — | — | Bal. |
| 21 | 5.0 | 45.7 | 3.3 | 0.21 | — | — | Bal. |
| 22 | 10.0 | 47.8 | 2.8 | 0.17 | — | 5.1 | Bal. |
| 23 | 8.0 | 46.4 | 3.3 | 0.27 | — | 5.1 | Bal. |
| 24 | 8.0 | 46.9 | 3.3 | 0.25 | 3.0 | 5.1 | Bal. |
| 25 | 7.13 | 46.0 | 2.93 | 0.20 | 5.55 | 3.05 | Bal. |
| 26 | 8.02 | 47.0 | 3.30 | 0.20 | 6.07 | 3.10 | Bal. |
| 27 | 9.02 | 46.0 | 3.38 | 0.24 | 6.58 | 3.10 | Bal. |
| 28 | 9.05 | 47.7 | 3.45 | 0.33 | 6.37 | 5.58 | Bal. |

TABLE I-continued

| Alloy | Composition (Wt. %)* (Wt. %)* Cr | Ni | Ti | Al | Mo | Co | Fe |
|---|---|---|---|---|---|---|---|

*The alloys also contained about 0.2% max. Mn, 0.2% max. Si, 0.04% max. C and 0.01 - 0.02 B - P and S were held to normal low values.

Tests were performed to determine the thermal expansion characteristics for the alloys set forth in Table I and more particularly, to compare their thermal expansion characteristics with the thermal expansion characteristics of AISI 4340 ferritic steel. Differences in thermal expansion for each of the alloys of Table I, on one hand, and for the 4340 steel, on the other hand, were calculated in terms of stress at various temperatures in accordance with the following equation:

$$\text{Stress} = (\Delta L)\ E$$

wherein:

1. $\Delta$ L is the difference in length between an alloy of Table I and the 4340 steel at the temperature of computation;
2. E is the elastic modulus for an alloy of Table I at the temperature of computation;
3. the alloy of Table I is assumed to be a fastener; e.g., a bolt;
4. the 4340 steel is assumed to be a casing; e.g., a steam turbine casing, heavy enough to resist deflection;
5. a positive stress indicates tightening;
6. a negative stress indicates loosening; and
7. the measured stress is algebraically additive with those mechanically imposed on the fastener at room temperature during assembly.

The stress values were subsequently used to classify the alloys in accordance with the degree of similarity between their thermal expansion characteristics and those of the 4340 steel. Alloys which resembled the 4340 steel to the greatest degree were classified as excellent while alloys which least resembled 4340 steel were classified as unacceptable. Other alloys with intermediate degrees of resemblance were classified as good or fair. The unacceptable alloys underwent a tightening in excess of 15 ksi or a loosening in excess of 10 ksi on heating to a temperature of approximately 1100° F. Results of the classification are set forth below in Table II.

TABLE II

| Alloy | THERMAL EXPANSION Excellent | Good | Fair | Unacceptable |
|---|---|---|---|---|
| 1 | | | | X |
| 2 | | | X | |
| 3 | | | X | |
| 4 | | | | X |
| 5 | | | X | |
| 6 | | | X | |
| 7 | | | X | |
| 8 | | | | X |
| 9 | | | | X |
| 10 | | | | X |
| 11 | | | X | |
| 12 | | | | X |
| 13 | | X | | |
| 14 | X | | | |
| 15 | X | | | |
| 16 | | X | | |
| 17 | | | | X |
| 18 | | X | | |
| 19 | | | X | |
| 20 | | | | X |
| 21 | | | | X |
| 22 | | X | | |
| 23 | | | X | |

TABLE II-continued

| Alloy | THERMAL EXPANSION Excellent | Good | Fair | Unacceptable |
|---|---|---|---|---|
| 24 | | X | | |
| 25 | | | X | |
| 26 | | | X | |
| 27 | | | | X |
| 28 | | | X | |

Figure 1:
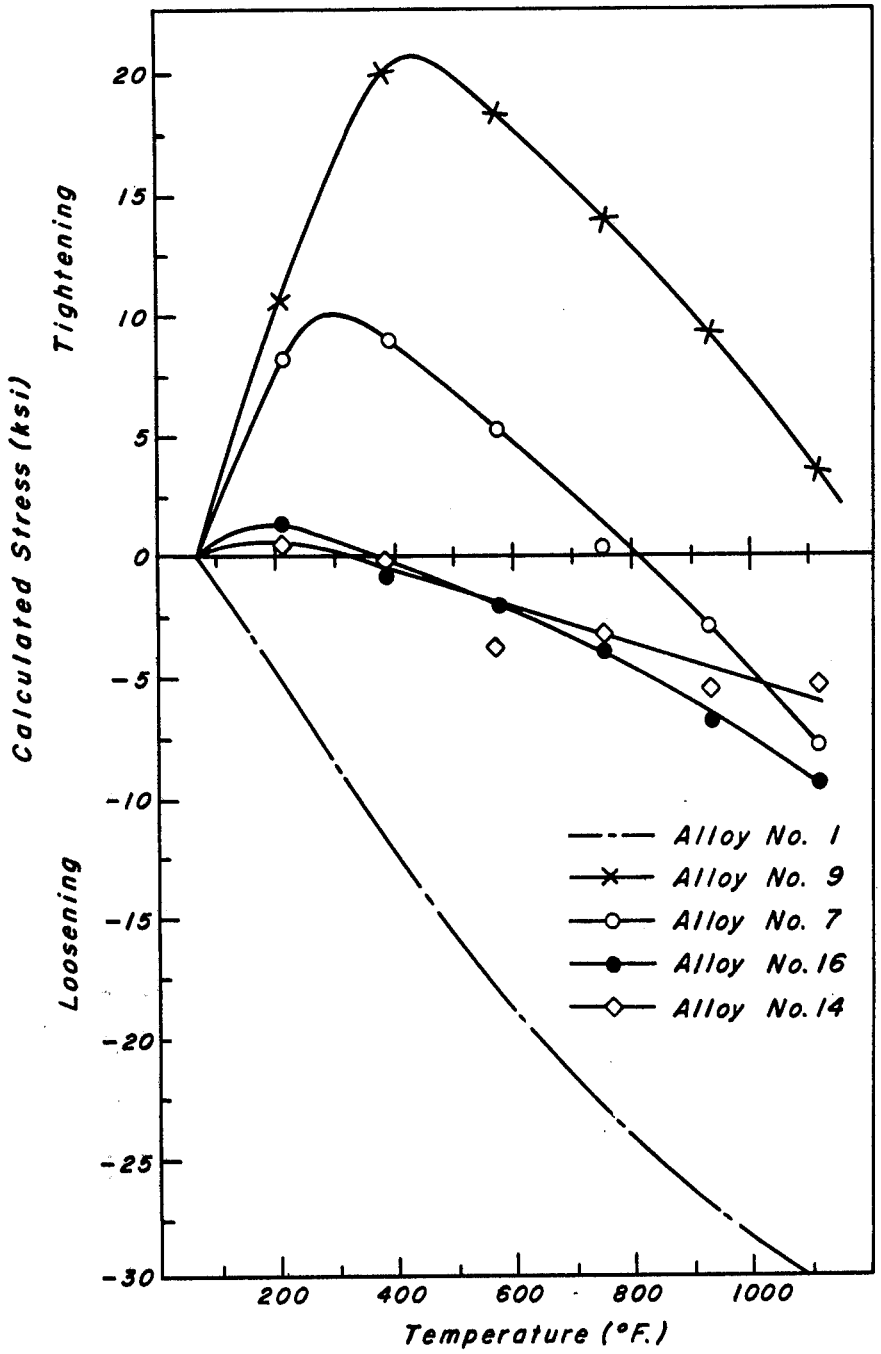
FIG. 1 is a plot (calculated stress versus temperature) showing how the thermal expansion characteristics for several experimental alloys compare to those of AISI 4340 steel.

The calculated stress values for several alloys appearing in Table I; i.e., alloy nos. 1,7,9,14 and 16, were plotted against temperature to demonstrate the classification of the alloys. FIG. 1 shows the plots for the alloys. Alloy No. 1, classified as unacceptable, underwent a considerable loosening on heating to 1100° F and alloy No. 9, also classified as unacceptable, underwent excessive over-tightening during heating. On the other hand, alloy No. 14, classified as excellent, shows very little tightening through the intermediate temperature range and had only about 5 ksi loosening on heating to 1100° F. Intermediately classified alloys, Nos. 7 (fair) and 16 (good), respectively show greater degrees of tightening through the intermediate temperature range than does alloy No. 14 (excellent) and also show loosening in excess of 5 ksi at the 1100° F temperature. With regard to the above, it should be noted that positive stresses shown in the intermediate temperature range are undesirable, as they must be added to the allowable initial torque-down stress at room temperature to satisfy engineering safety criteria.

Figure 2:
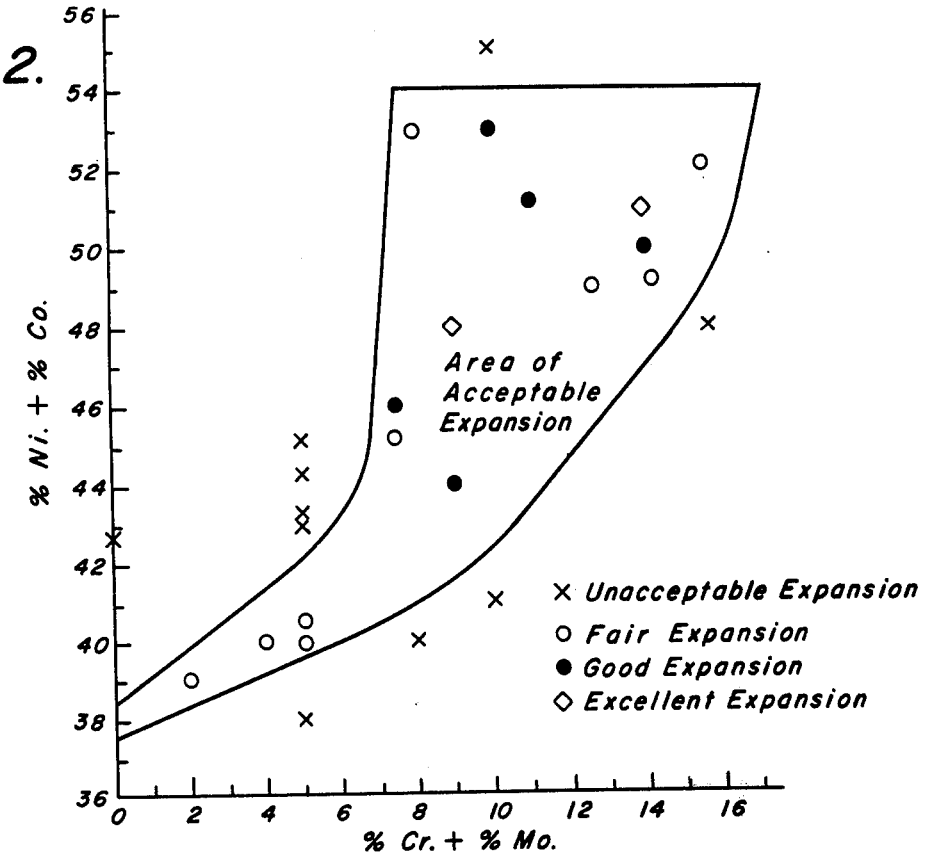
FIG. 2 is a plot (% Ni plus % Co versus % Cr + % Mo) defining an area of acceptable thermal expansion.

A chemistry plot of % Ni + % Co (those elements which directly influence the inflection point temperature) against % Cr + % Mo (those elements which directly influence the overall minimum in expansivity) was made to show the combination of elements which give a thermal expansion rate comparable to the 4340 steel. The plot is shown in FIG. 2. All alloys of this invention must fall within the defined area of acceptable expansion. The nickel level used in the plot is the effective nickel value in accordance with the equation:

$$\%\ \text{effective Ni} = \%\ \text{actual Ni} - 2.4\ [(\%\ \text{Ti} - 2.8) - 4\ (\%\ \text{C})]$$

Stress rupture tests were conducted upon a number of the alloys appearing in Table I. The properties of the alloys tested are shown below in Table III wherein the Larson-Miller (C=20) extrapolated rupture stress for 100,000 hours life at 1000° F is used as the measure of performance.

TABLE III

| Alloy | STRESS RUPTURE PROPERTIES Extrapolated Stress (ksi) for 100,000 hours life at 1000° F (Larson-Miller with C = 20) |
|---|---|
| 1 | 74 |
| 7 | 58 |
| 9 | 63 |
| 11 | 60 |
| 12 | 60 |
| 13 | 60 |
| 14 | 72 |
| 15 | 64 |

TABLE III-continued

| Alloy | STRESS RUPTURE PROPERTIES Extrapolated Stress (ksi) for 100,000 hours life at 1000° F (Larson-Miller with C = 20) |
|---|---|
| 16 | 75 |
| 17 | 80 |
| 18 | 52 |
| 19 | 60 |
| 20 | 61 |
| 21 | 60 |
| 22 | 70 |
| 24 | 79 |
| 25 | 65 |
| 26 | 72 |
| 28 | 77 |

A study of the results of Table III reveals that a number of alloys having acceptable thermal expansion do not have acceptable stress rupture properties. As stated above, the alloy of this invention has a Larson-Miller (C=20) extrapolated stress of at least 64 ksi, preferably at least 69 ksi, for 100,000 hours at 1000° F.

A plot of those alloys appearing in Table I having both acceptable expansion and acceptable stress rupture properties; i.e., alloy Nos. 14, 15, 16, 22, 24 – 26 and 28, was superimposed upon the outline of FIG. 2 to show the combination of elements required by the alloy of this invention. The pertinent part of the superimposed plot is shown in the cross-hatched area of FIG. 3. The cross-hatched area represents the combination of elements which must be met by the alloy of this invention; i.e., a percentage of nickel plus a percentage of cobalt and a percentage of chromium plus a percentage of molybdenum which corresponds to the area ACEFA.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. A controlled expansion austenitic alloy having ferritic-like thermal expansion and high temperature strength, consisting essentially of, in weight percent, from 36 to 54% nickel, up to 12% cobalt, up to 11% chromium, up to 10% molybdenum, from 1 to 3.75% titanium, up to 0.35% aluminum, up to 0.1% carbon, up to 2% manganese, up to 1% silicon, up to 0.05% boron, balance essentially iron; said percentage of iron being at least 24%; said percentage of nickels plus said percentage of cobalt and said percentage of chromium plus said percentage of molybdenum corresponding to the area ACEFA in FIG. 3; said percentage of nickel being effective nickel in accordance with the equation:

$$\% \text{ effective Ni} = \% \text{ actual Ni} - 2.4\,[(\% \text{ Ti} - 2.8) - 4(\% \text{ C})]$$

2. A controlled expansion austenitic alloy according to claim 1 having from 43 to 49% nickel, up to 6% cobalt, up to 11% chromium, up to 7% molybdenum, from 2.4 to 3.4% titanium, up to 0.04% carbon, up to 0.25% manganese, up to 0.25% silicon, up to 0.02% boron.

3. A controlled expansion austenitic alloy according to claim 1 having from 2 to 6% cobalt.

4. A controlled expansion austenitic alloy according to claim 1 having from 3 to 11% chromium.

5. A controlled expansion austenitic alloy according to claim 1 having from 2 to 7% molybdenum.

6. A controlled expansion austenitic alloy according to claim 1 having from 49 to 54% nickel plus cobalt and from 9 to 15% chromium plus molybdenum.

7. A controlled expansion austenitic alloy according to claim 1 having at least 28% iron.

8. A controlled expansion austenitic alloy according to claim 1 having from 2 to 6% cobalt, from 3 to 11% chromium, from 2 to 7% molybdenum, from 49 to 54% nickel plus cobalt and from 9 to 15% chromium plus molybdenum.

9. A controlled expansion austenitic alloy according to claim 1 having a Larson-Miller (C=20) extrapolated rupture stress of at least 64 ksi for 100,000 hours at 1000° F, and having up to 6% cobalt, up to 11% chromium, up to 7% molybdenum and at least 28% iron.

10. A controlled expansion austenitic alloy according to claim 9 having a Larson-Miller (C=20) extrapolated rupture stress of at least 69 ksi for 100,000 hours at 1000° F, and having from 2 to 6% cobalt, from 3 to 11% chromium, from 2 to 7% molybdenum and from 2.4 to 3.4% titanium.

11. A controlled expansion austenitic alloy according to claim 1 having from 0.01 to 0.02% boron.

* * * * *